US007125367B1

(12) United States Patent
Stearns

(10) Patent No.: US 7,125,367 B1
(45) Date of Patent: Oct. 24, 2006

(54) MULTI-PURPOSE EXERCISE APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 459 days.

(21) Appl. No.: 10/291,893

(22) Filed: Nov. 8, 2002

(51) Int. Cl.
*A63B 26/00* (2006.01)
*A63B 71/00* (2006.01)

(52) U.S. Cl. ..... 482/141; D21/665; 482/62

(58) Field of Classification Search ..... 482/141, 482/62, 79–80, 70–72, 14, 19, 23; D21/677, D21/665, 662
See application file for complete search history.

(56) References Cited

U.S. PATENT DOCUMENTS 3,559,986 A * 2/1971 Ehrmantraut ..... 482/70
4,659,077 A * 4/1987 Stropkay ..... 482/70
6,186,930 B1 * 2/2001 Ignaczak ..... 482/141
6,280,366 B1 * 8/2001 Hsieh ..... 482/130
6,368,253 B1 * 4/2002 Harrigan ..... 482/70
6,368,254 B1 * 4/2002 Wall ..... 482/71
6,514,180 B1 * 2/2003 Rawls ..... 482/70
6,716,145 B1 * 4/2004 Manailovich ..... 482/141
6,786,850 B1 * 9/2004 Nizamuddin ..... 482/51
2004/0029685 A1 * 2/2004 Wall ..... 482/141
2004/0053752 A1 * 3/2004 Yang ..... 482/70

* cited by examiner

*Primary Examiner*—Lori Amerson

(57) ABSTRACT

An exercise device includes a frame, and left and right force receiving members movably mounted on the frame. The force receiving members are selectively linked to one another to facilitate a first mode of exercise, wherein a person's hands or legs are repeatedly moved toward and away from one another. When so linked, the force receiving members may alternatively be biased toward one another or away from one another. The force receiving members may be decoupled to facilitate a second mode of exercise, wherein a person stretches and/or leans forward and then returns backward.

18 Claims, 6 Drawing Sheets

100
131
116
132
151
114
139

100
131
139
147
132
118
118
112

100
118
117
154
153
146
122
121
125
120
119
115
118
112
110

MULTI-PURPOSE EXERCISE APPARATUS

FIELD OF THE INVENTION

The present invention relates to exercise methods and apparatus.

BACKGROUND OF THE INVENTION

Various exercise devices have been developed to exercise various muscles of the human body. Also, many different types of devices are typically developed with respect to any particular exercise in order to accommodate different levels of consumer expectation. Despite many such efforts, a need remains for a relatively inexpensive exercise device that accommodates more than one type of exercise, and/or a relatively inexpensive exercise device that facilitates arm exercise along converging stpaths of motion.

SUMMARY OF THE INVENTION

The present invention provides exercise apparatus and methods suitable for accommodating multiple types of exercise and/or for accommodating convergent arm exercise. A preferred embodiment of the present invention includes left and right force receiving members that accommodate convergent chest press exercises, inner thigh exercises, outer thigh exercises, and torso exercises. Many of the features and advantages of the present invention will become apparent to those skilled in the art from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a preferred embodiment exercise device constructed according to the principles of the present invention;

DETAILED DESCRIPTION OF A PREFERRED EMBODIMENT

Figure 1:
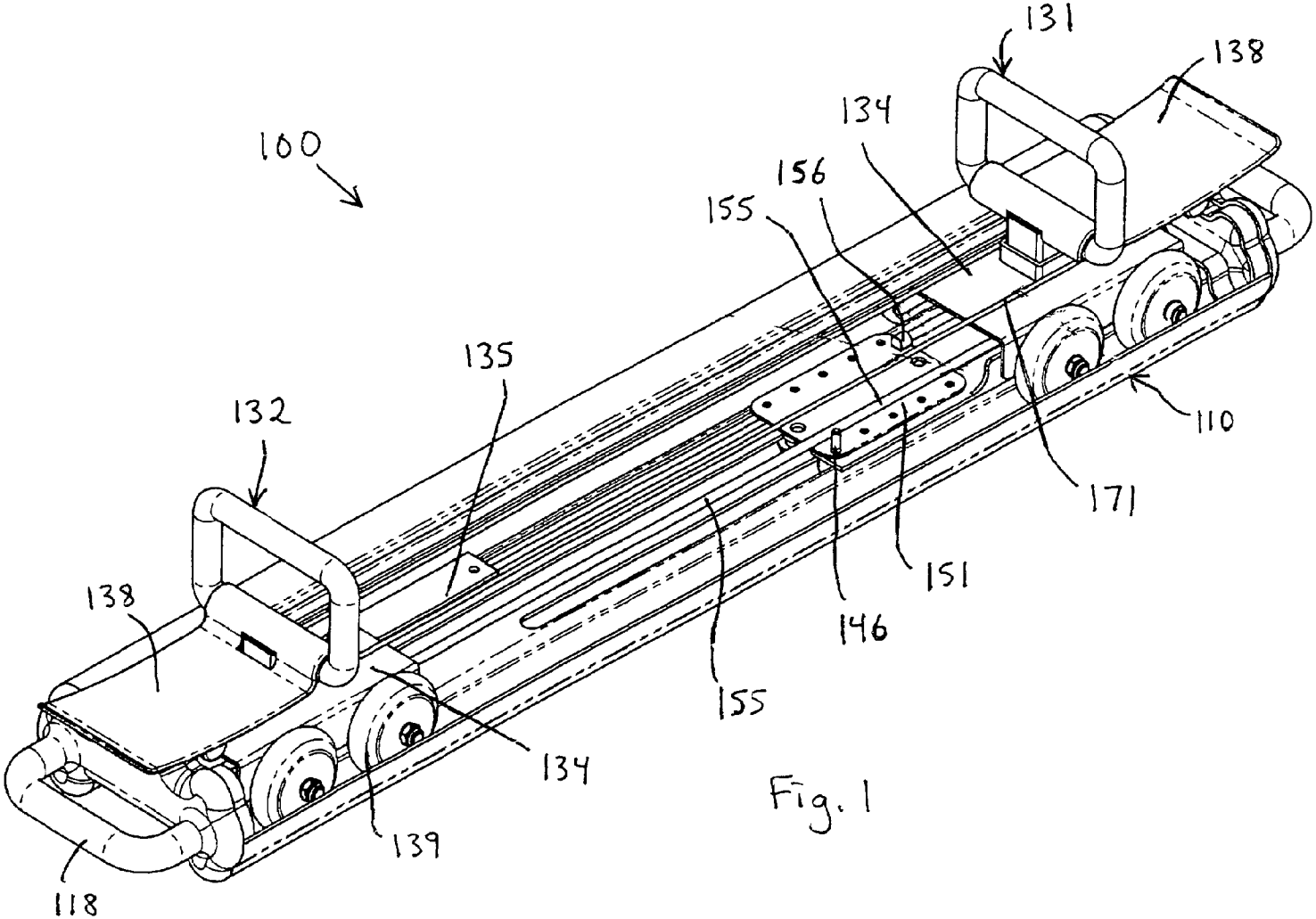

A preferred embodiment exercise device constructed according to the principles of the present invention is designated as 100 in FIGS. 1–6 and 11–12. The device 100 generally includes a frame 110, left and right force receiving members 131 and 132 movably mounted on the frame 110, a resistance system 150 interconnected between the frame 110 and at least one of the force receiving members 131 and 132, and a linkage system 170 selectively interconnected between the force receiving members 131 and 132. As further discussed below, the device 100 may be operated in different modes to facilitate a variety of exercises.

Figures 2, 3, 4:
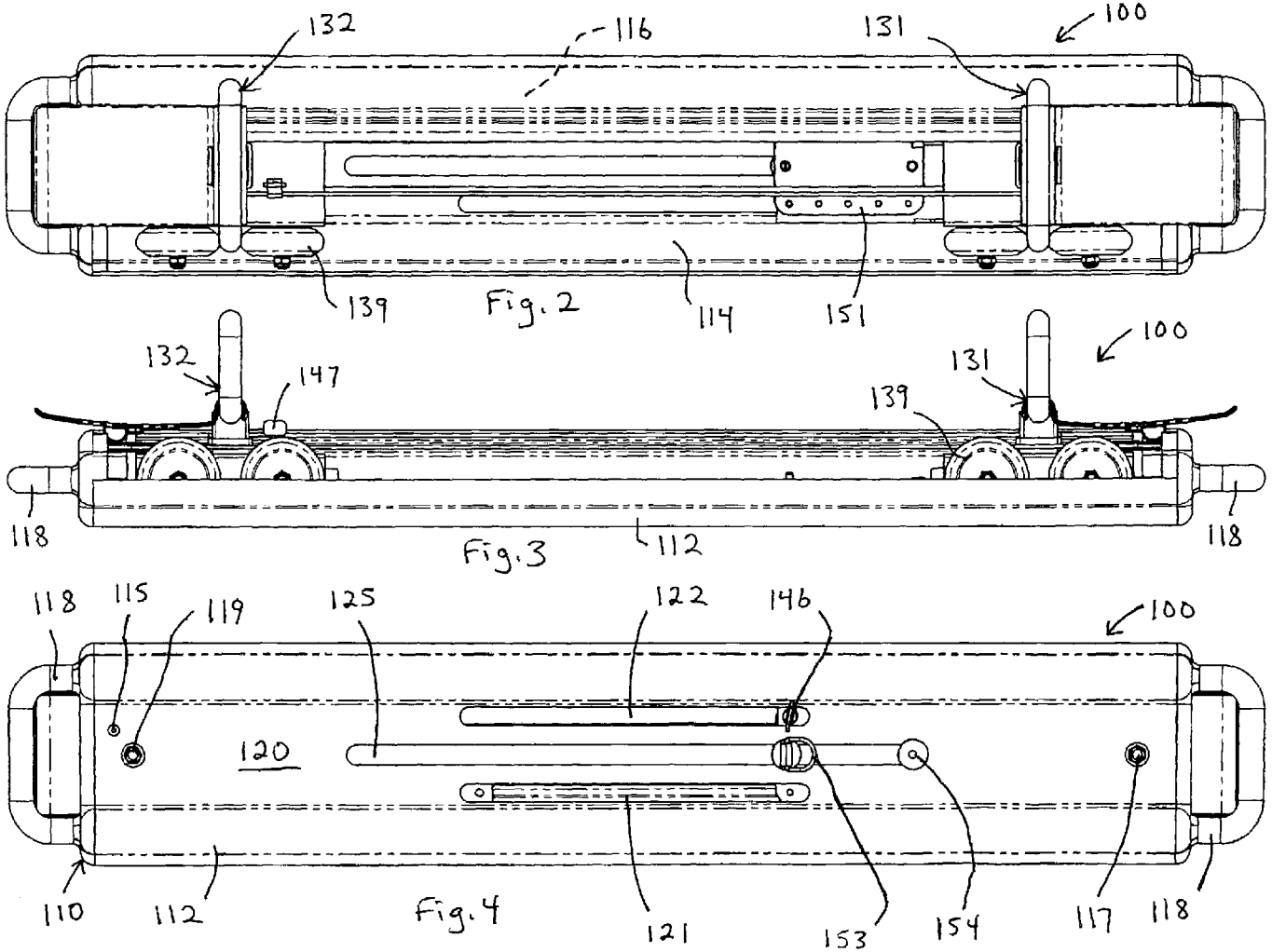
FIG. 2 is a top view of the exercise device of FIG. 1.
FIG. 3 is a side view of the exercise device of FIG. 1.
FIG. 4 is a bottom view of the exercise device of FIG. 1.
Figure 6:
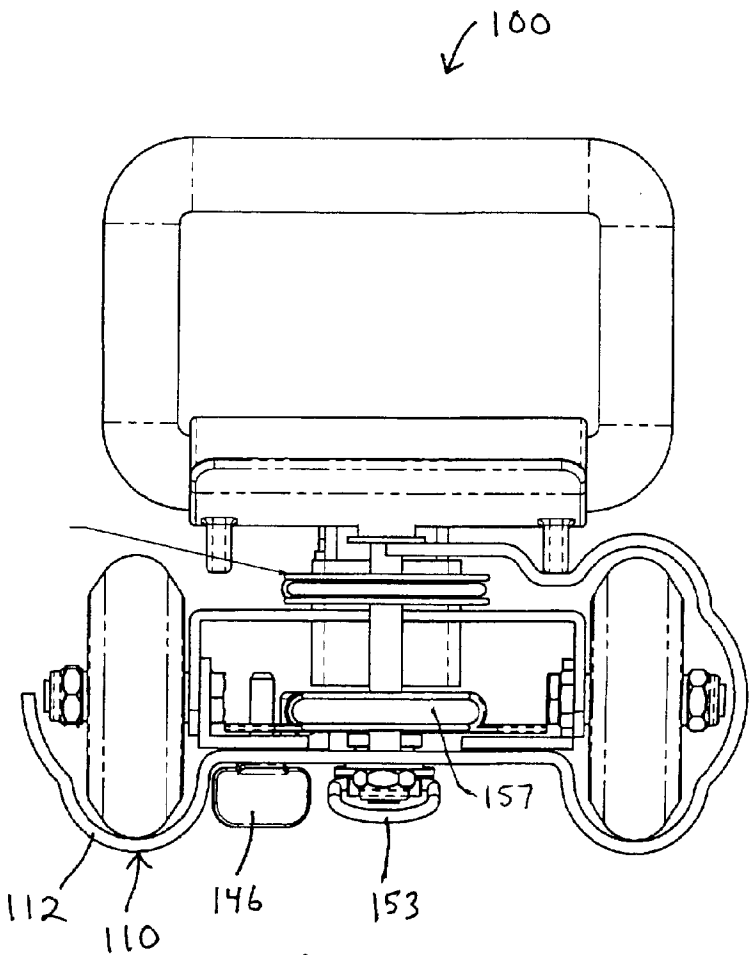
FIG. 6 is an opposite end view of the exercise device of FIG. 1 with an opposite end cap removed to better illustrate the remaining components.
Figure 5:
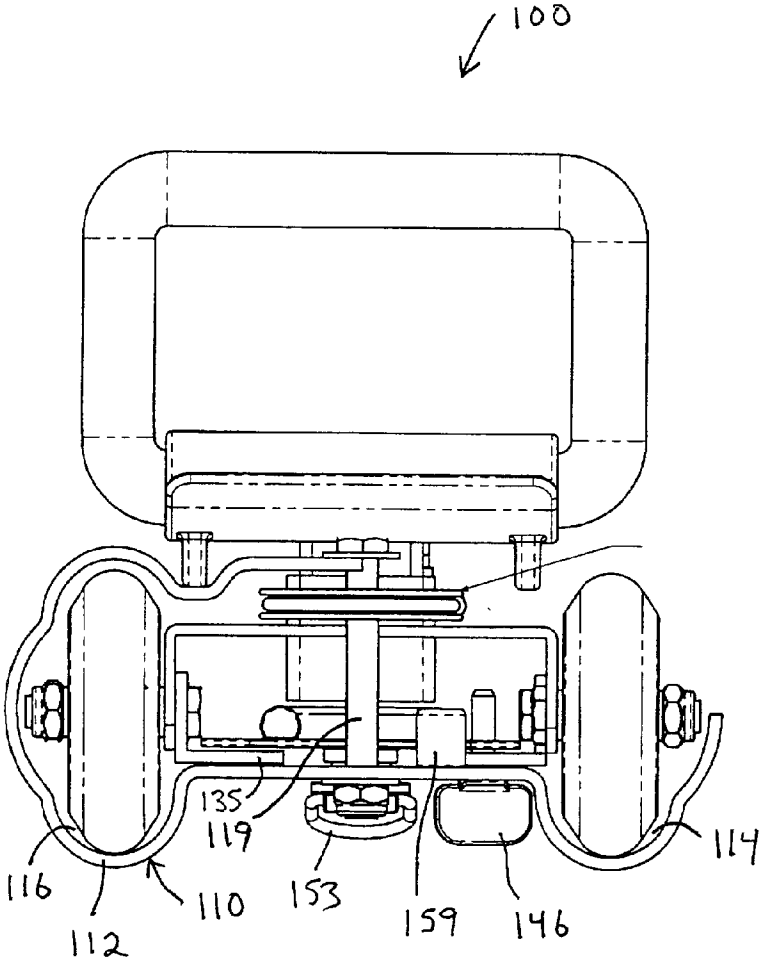
FIG. 5 is an end view of the exercise device of FIG. 1, with an end cap removed to better illustrate the remaining components.
Figure 7:
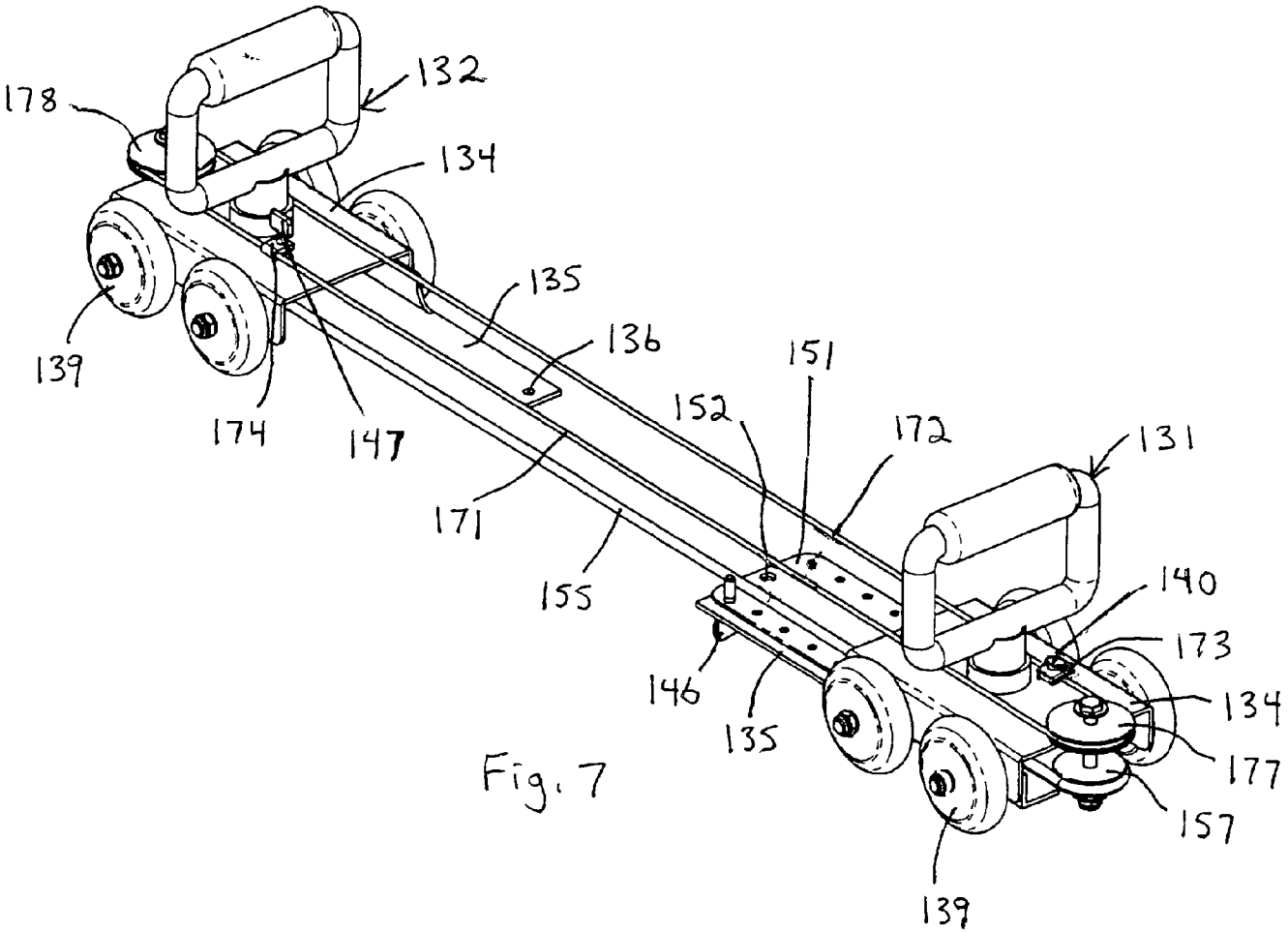
FIG. 7 is a perspective view of the exercise device of FIG. 1, with certain parts removed to better illustrate the remaining components.
Figure 8:
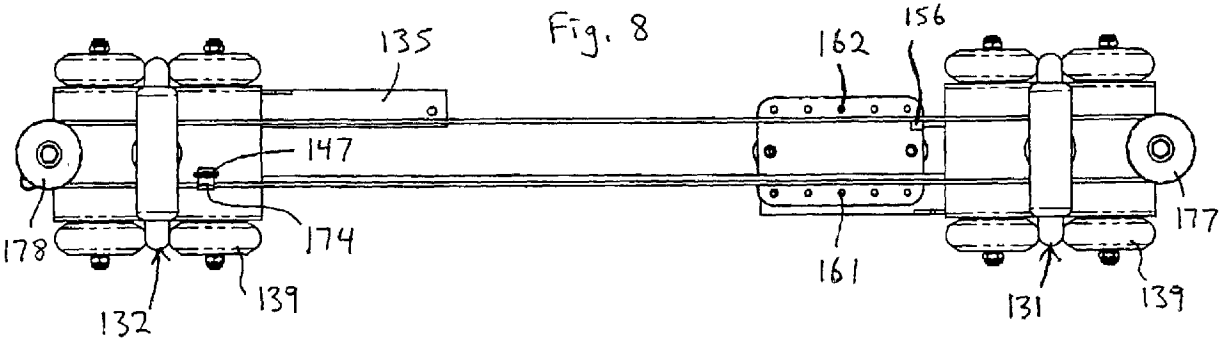
FIG. 8 is a top view of the exercise device components of FIG. 7.
Figure 9:
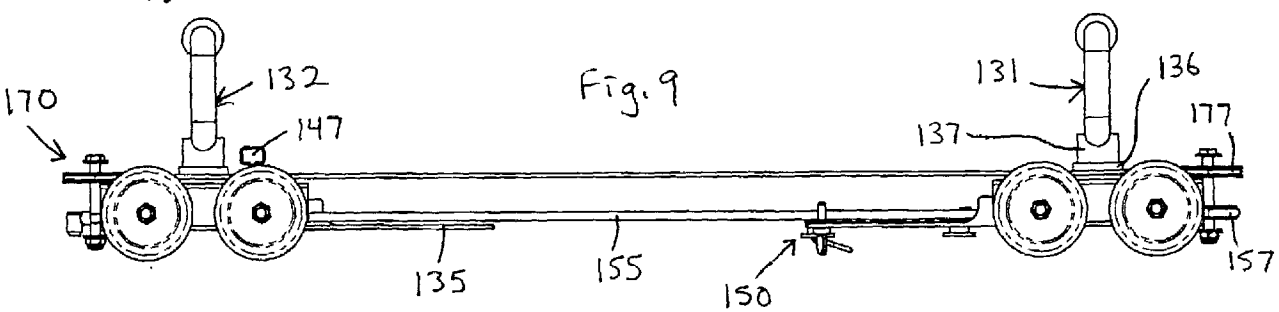
FIG. 9 is a side view of the exercise device components of FIG. 7.
Figure 10:
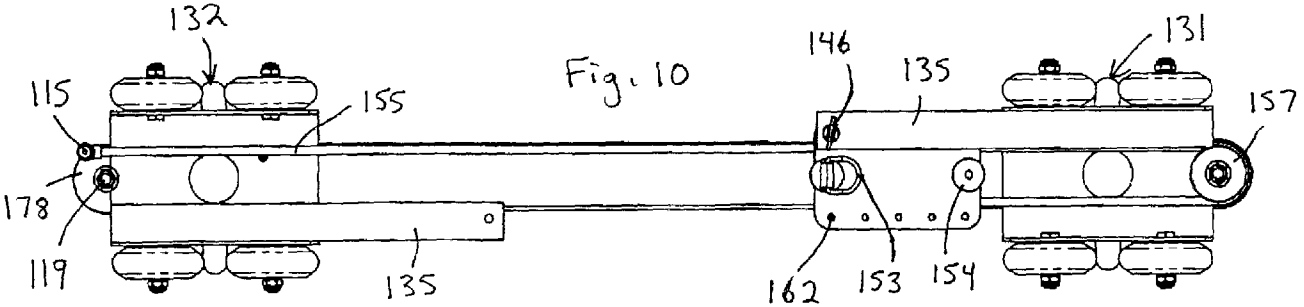
FIG. 10 is a bottom view of the exercise device components of FIG. 1.

The frame 110 may take various forms and/or be made in various manners. On the preferred embodiment 100, the frame 110 is preferably an extruded rail 112 having a uniform profile that is shown in FIGS. 5–6. The rail 112 is configured to define a first track or channel 114 that is uncovered or visible from above, and a second track or channel 116 that is covered. As shown in FIG. 4, three elongate slots 121, 122, and 125 are formed in a bottom side 120 of the rail 112 for reasons discussed below. A separate handle 118 is configured for insertion into each end of the rail 112, and is rigidly secured thereto by means of a respective bolt 119 (shown in FIGS. 4–6). Each handle 118 is sized and configured for grasping as further discussed below. The handles 118 are omitted from FIGS. 5–6 in order to better illustrate the components disposed inside the rail 112.

Each force receiving member 131 and 132 may take various forms and/or be made in various manners. As suggested by the common reference numerals, the force receiving members 131 and 132 are similar in many respects. On the preferred embodiment 100, each force receiving member 131 and 132 may be described as a car or skate that is rollably mounted on the frame 110.

Among other things, each force receiving member 131 and 132 includes a base or body 134 that has an inverted U-shaped profile and is preferably a stamped metal part. Pairs of rollers or wheels 139 are rotatably mounted on opposite sides of each base 134 in a manner known in the art. The arrangement is such that the rollers 139 align with respective tracks 114 and 116. A bar or extension 135 is secured to each base 134 (by means of the bolts associated with the rollers 139 on one side of each base 134), and projects outward toward an opposite force receiving member 131 or 132. The bar 135 on the force receiving member 131 is proximate the open track 114, and the bar 135 on the force receiving member 132 is proximate the closed track 116. A hole extends through the distal end of each bar 135 for reasons discussed below.

A cylindrical tube or collar 136 is mounted on each base 134 to provide an upwardly opening hole. The tube 136 is preferably a metal pipe that is secured in place by welding, swaging, or other means known in the art. A bearing member 137 has a first end that is sized and configured for insertion into the tube 136, an opposite, second end or handle that is sized and configured to be grasped in a person's hand, and an intermediate portion that is sized and configured to bear against a person's thigh. Each bearing member 137 is rotatable about a vertical axis relative to a respective base 134.

A leg plate 138 is selectively mounted on each bearing member 137 by snap fit or other means known in the art. In this regard, each leg plate 138 is preferably provided with an end that is contoured to snap onto a cylindrical portion of the bearing member 137. The remainder of each leg plate 138 is configured to rest on top of a person's thigh. In FIGS. 1–6, the leg plates 138 are shown in respective outboard positions relative to the bearing members 137. The leg plates 138 may be moved to respective inboard positions simply by rotating the bearing members 137 relative to respective bases 134.

FIGS. 7–10 show the force receiving members 131–132, the resistance system 150, and the linking system 170 apart from the frame 110 for purposes of clearer illustration. The resistance system 150 includes an elastic cord 155 having a first end connected to a first end of the frame 110 at rivet 115, an intermediate portion routed about a pulley 157 on an opposite end of the frame 110, and a second end connected to a connector or slide 151 at crimp 156. The routing of the elastic cord 155 about the pulley 157 provides a more gradual resistance curve (than if a cord were interconnected directly between the slide 151 and either end of the frame 110). Those skilled in the art will also recognize that more than one elastic cord may be provided, and/or different combinations of elastic cords may be selectively connected to the slide 151 to provide different resistance curves.

The slide 151 is movably mounted on the frame 110 by means of fasteners 152 and 154 that extend through the slot 125 in the bottom side 120 of the frame 110. A pull ring 153 is secured to the bottom side of the slide 151 by means of the fastener 152. A first row of holes 161 extends along a first side of the slide 151, and a second row of holes 162 extends along a second side of the slide 151. FIGS. 1–10 show a detent pin 146 inserted through the hole in the bar 135 on the first force receiving member 131, and through one of the holes 161 in the slide 151. In this configuration, the first force receiving member 131 is fastened to the slide 151, and the elastic cord 155 resists movement of the first force receiving member 131 toward the second force receiving member 132. The level of resistance may be increased by removing the pin 146, pulling the slide 151 away from the first force receiving member 131 (using the pull ring 153), and inserting the pin 146 through the same hole in the same bar 135, but through a different hole 161 in the slide 151.

The slide 151 may be fastened to the second force receiving member 132 to arrive at a different configuration. This reconfiguration involves removing the pin 146, moving the second force receiving member 132 toward the slide 151 until the hole in the associated bar 135 aligns with one of the holes 162 in the slide 151, and inserting the pin 146 through the aligned holes. In this configuration, the elastic cord 155 resists movement of the second force receiving member 132 away from the first force receiving member 131. Again, the level of resistance may be increased by removing the pin 146, pulling the slide 151 toward the second force receiving member 132 (using the pull ring 153), and inserting the pin 146 through the same hole in the same bar 135, but through a different hole 162 in the slide 151.

The linking system 170 includes a first cable portion 171 and a second cable portion 172 that cooperate to form a closed loop. The two cable portions 171 and 172 are shown as integrally connected segments of a single cable, but they may be separate segments in the alternative. The first cable portion 171 extends from a connector 173 associated with the first force receiving member 131, about a pulley 177 on a first end of the frame 110, and to a connector 174 associated with the second force receiving member 132. The second cable portion 172 extends from the connector 174 associated with the second force receiving member 132, about a pulley 178 on an opposite, second end of the frame 110, and to the connector 173 associated with the first force receiving member 131.

The connector 173 is clamped onto the cable portions 171 and 172, and is bolted onto the base 134 associated with the first force receiving member 131. The connector 174 is clamped onto the cable portions 171 and 172, and is selectively pinned to the base 134 associated with the second force receiving member 132. When the detent pin 147 is inserted through the connector 174 and into the base 134 associated with the second force receiving member 132, the force receiving members 131 and 132 are constrained to move in opposite directions relative to the frame 110. Otherwise, each force receiving member 131 and 132 is free to move independent of the other.

Use of the exercise device 100 may be described in terms of various exercise or methods of exercise. For example, a person may exercise his inner thigh muscles by configuring the exercise device 100 as shown in FIGS. 1–10, and inserting the pin 147 into the base 134 associated with the second force receiving member 132. In this configuration, the leg plates 138 occupy respective outboard positions, and the force receiving members 131 and 132 are linked to move in opposite directions and biased to remain away from one another. The person assumes a sitting position on a chair and places the exercise device 100 bottom side 120 up on his lap with respective leg plates 138 resting on top of his thighs. The person then holds the handles 118 in respective hands and squeezes his thighs together to move the bearing members 137 toward one another subject to stretching of the elastic cord 155.

A person may reconfigure the exercise device to alternatively exercise his outer thigh muscles. In this configuration, the slide 151 is alternatively connected to the second force receiving member 132 (thereby reversing the biasing effect of the elastic cord 155), and the leg plates 138 are moved to respective inboard positions. The person again assumes a sitting position on a chair and places the exercise device 100 bottom side 120 up on his lap with respective leg plates 138 resting on top of his thighs. The person then holds the handles 118 in respective hands and spreads his thighs apart to move the bearing members 137 away from one another subject to stretching of the elastic cord 155.

Figure 11:
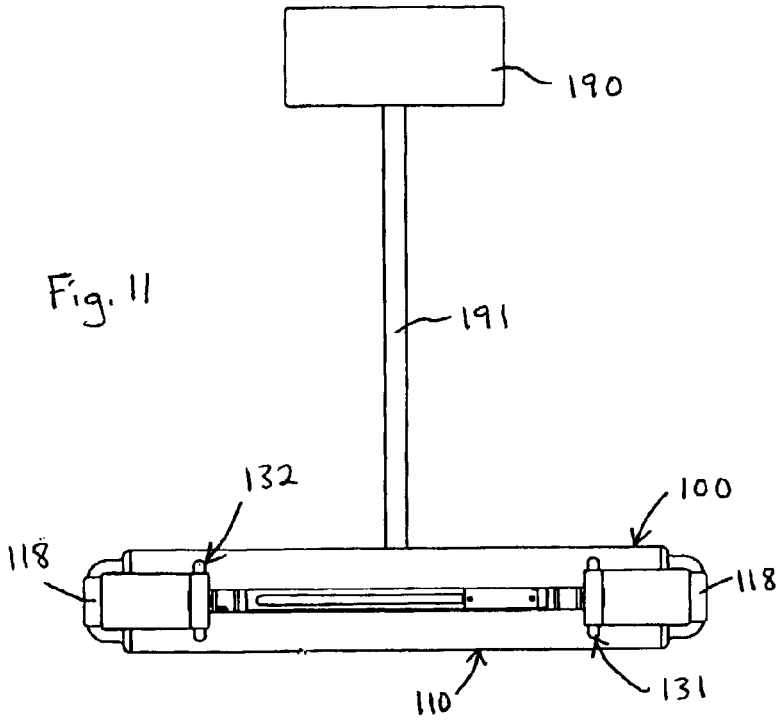
FIG. 11 is a top view of the exercise device of FIG. 1 with a knee pad connected thereto to facilitate a particular type of exercise.

In another mode of operation, a person may exercise his upper body by assuming a kneeling position on a floor surface, grasping the bearing members 137 in respective hands, placing the bottom side 120 of the exercise device 100 on the floor surface, assuming a push-up position, and performing push-up exercises while moving the bearing members 137 inward and outward. In order to facilitate a type of exercise sometimes referred to as "convergence" exercise, the exercise device 100 is preferably configured as shown in FIGS. 1–10, with the force receiving members 131 and 132 link to move in opposite directions, and the slide 151 fastened to the first force receiving member 131 (to resist convergence of the force receiving members 131 and 132). As shown in FIG. 11, a knee pad 190 may be connected to a central portion of the frame 110 in anticipation of performing the push-up type exercise. The knee pad 190 is preferably a reinforced foam mat, and the means of connection is preferably a nylon strap 191. The strap 191 may be adjustably connected to the frame 110 by hook-and-loop type fasteners, a loop and buckle arrangement, or other means known in the art.

Figure 12:
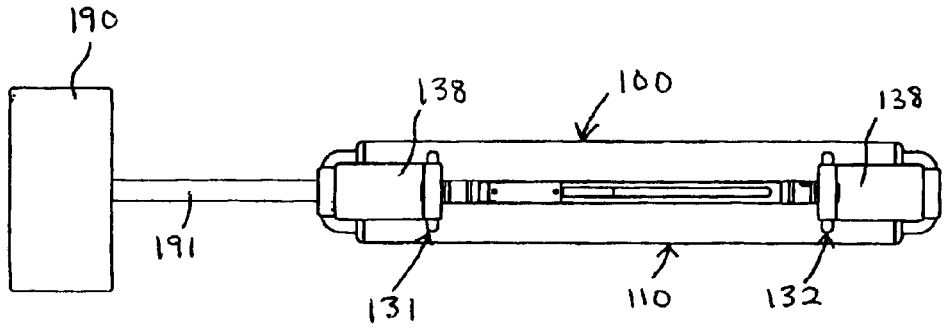
FIG. 12 is a top view of the exercise device of FIG. 1 with the knee pad of FIG. 11 connected thereto to facilitate another particular type of exercise.

FIG. 12 shows the exercise device 100 configured for yet another mode of operation (of a type similar to that associated with the exercise device disclosed in U.S. Pat. No. 6,071,217 to Barnett, which is incorporated herein by reference). In this configuration, the exercise device 100 is configured as shown in FIGS. 1–10 but without the force receiving members 131 and 132 interconnected via the pin 147. The exercise device 100 is placed on the floor in such a manner that the force receiving members are accessible from above. The knee pad 190 is connected to an end of the frame 110 and adjusted relative thereto, if necessary. A person then kneels on the knee pad 190 and grasps the force receiving member 131 in both hands. The person leans forwards and/or reaches forward to moving the force receiving member 131 toward the force receiving member 132, subject to increasing tension in the elastic cord 155, and then the person leans backwards and/or pulls back his arms to allow return of the force receiving member 131 toward its rest position.

The present invention has been described with reference to a preferred embodiment and particular applications. However, this disclosure will also enable persons skilled in the art to recognize additional embodiments and/or applications which incorporate the essence of the present invention. With the foregoing in mind, the scope of the present invention is to be limited only to the extent of the following claims.

What is claimed is:

1. A method of exercise comprising the steps of:

providing an exercise device having a frame, first and second handles movably mounted on the frame and linked to one another and moving in opposite directions relative to one another, and a resistance device that resists movement of at least one of the handles relative to the frame;

arranging a cable in a closed loop about pulleys on opposite ends of the frame and connecting each of the handles to a discrete side of the loop, placing the exercise device on a floor in such a manner that the handles are accessible from above, grasping the handles in one's respective hands, arranging one's body in a push-up position, and performing a push-up while simultaneously moving the handles toward one another.

2. The method of claim 1, further comprising the step of configuring the resisting device to resist movement of the handles away from one another.

3. The method of claim 1, further comprising the step of configuring the resistance device to resist movement of the handles toward one another.

4. The method of claim 1, wherein the grasping step is performed prior to the placing step.

5. The method of claim 1, further comprising the step of adjusting the resistance device prior to performing the push-up, wherein the adjusting step involves providing the exercise device with a connector movably mounted on the frame between the handles and with at least one elastic cord interconnected between the connector and the frame, and fastening the connector in an alternative position relative to one of the handles prior to the grasping step.

6. The method of claim 1, wherein the exercise device is provided with first and second cars rollably mounted on the frame, and the handles are rotatably mounted on respective said cars, and further comprising the step of rotating the handles to desired orientations prior to performing the push-up.

7. A method of exercise comprising the steps of:

providing an exercise device having a frame, first and second force receiving members movably mounted on the frame, and a resistance device operable to resist movement of at least one of the force receiving members relative to the frame;

in a first mode of operation, arranging one's body in a seated position on a chair, placing the exercise device on one's lap in such a manner that the force receiving members extend downward from the frame, and using one's legs to exert force against the force receiving members and thereby move the force receiving members relative to the frame; and in a second mode of operation, placing the exercise device on a floor in such a manner that the force receiving members are accessible from above, and using one's body to exert force against the force receiving members and thereby move the force receiving members relative to the frame.

8. The method of claim 7, further comprising the step of linking the force receiving members to move in opposite directions relative to one another.

9. The method of claim 7, further comprising the step of configuring the resistance device to resist movement of the force receiving members away from one another.

10. The method of claim 9, further comprising the step of linking the force receiving members to move in opposite directions relative to one another.

11. The method of claim 7, further comprising the step of configuring the resistance device to resist movement of the force receiving members toward one another.

12. The method of claim 11, further comprising the step of linking the force receiving members to move in opposite directions relative to one another.

13. The method of claim 7, wherein in the second mode of operation one's body is arranged in a push-up position on the floor, with one's hands grasping respective force receiving members.

14. The method of claim 7, wherein the exercise device is provided with handles rigidly mounted on opposite ends of the frame, and in the first mode of operation, the handles are grasped in one's hands to stabilize the exercise device.

15. The method of claim 7, wherein the exercise device is provided with leg plates on the force receiving members, and in the first mode of operation, the force receiving members are disposed between a person's thighs to facilitate an inner thigh exercise, and the leg plates are moved to respective outboard positions to overlie the person's thighs during the inner thigh exercise, and alternatively, a person's thighs are disposed between the force receiving members to facilitate an outer thigh exercise, and the leg plates are moved to respective inboard positions to overlie the person's thighs during the outer thigh exercise.

16. The method of claim 7, wherein in a third mode of operation, placing the exercise device on the floor in such a manner that the force receiving members are accessible from above, connecting a knee pad to the frame, kneeling on the knee pad, grasping one of the force receiving members in one's hands, and moving said one of the force receiving members relative to the frame and to and fro relative to the knee pad.

17. A method of exercise, comprising the steps of:

providing an exercise device having a frame, first and second handles movably mounted on the frame, and a resistance device that resists movement of at least one of the handles relative to the frame;

adjusting the resistance device, wherein the adjusting involves providing the exercise device with a connector movably mounted on the frame between the handles and with at least one elastic cord interconnected between the connector and the frame, and fastening the connector in an alternative position relative to one of the handles;

placing the exercise device on a floor in such a manner that the handles are accessible from above;

grasping the handles in one's respective hands;

arranging one's body in a push-up position; and performing a push-up while simultaneously moving the handles toward one another.

18. A method of exercise, comprising the steps of:

providing an exercise device having a frame, first and second cars rollably mounted on the frame, first and second handles rotatably mounted on respective said cars, and a resistance device that resists movement of at least one of the handles relative to the frame;

rotating the handles to desired orientations relative to respective said cars;

placing the exercise device on a floor in such a manner that the handles are accessible from above;

grasping the handles in one's respective hands;

arranging one's body in a push-up position; and performing a push-up while simultaneously moving the handles toward one another.

* * * * *